US009551202B2

(12) United States Patent
Corre et al.

(10) Patent No.: US 9,551,202 B2
(45) Date of Patent: Jan. 24, 2017

(54) SYSTEM AND METHOD FOR SAMPLING ASSEMBLY WITH OUTER LAYER OF RINGS

(71) Applicant: Schlumberger Technology Corporation, Sugar Land, TX (US)

(72) Inventors: Pierre-Yves Corre, Eu (FR); Kathiravane Tingat Cody, Le Plessis-Robinson (FR); Stephane Metayer, Abbeville (FR); Jean-Louis Pessin, Amiens (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 712 days.

(21) Appl. No.: 13/925,065

(22) Filed: Jun. 24, 2013

(65) Prior Publication Data

US 2013/0341016 A1 Dec. 26, 2013

Related U.S. Application Data

(60) Provisional application No. 61/663,901, filed on Jun. 25, 2012.

(51) Int. Cl.

| | |
|---|---|
| ***E21B 33/12*** | (2006.01) |
| ***E21B 49/08*** | (2006.01) |
| ***E21B 33/122*** | (2006.01) |

(52) U.S. Cl.

CPC ..... *E21B 33/1208* (2013.01); *E21B 33/122* (2013.01); *E21B 49/081* (2013.01); *E21B 49/084* (2013.01)

(58) Field of Classification Search

CPC .. E21B 33/1208; E21B 33/127; E21B 49/081; E21B 49/084; E21B 33/122

See application file for complete search history.

(56) References Cited

U.S. PATENT DOCUMENTS

| | | | | |
|---|---|---|---|---|
| 8,091,634 | B2 | 1/2012 | Corre et al. | |
| 2009/0308604 | A1* | 12/2009 | Corre | E21B 49/084 166/250.17 |
| 2010/0071898 | A1* | 3/2010 | Corre | E21B 33/12 166/264 |
| 2011/0277999 | A1 | 11/2011 | Corre et al. | |

FOREIGN PATENT DOCUMENTS

| | | | |
|---|---|---|---|
| WO | 2012054865 | A2 | 4/2012 |

OTHER PUBLICATIONS

International Search Report and Written Opinion for International Application No. PCT/US2013/047489 dated Sep. 25, 2013.

* cited by examiner

*Primary Examiner* — David Andrews
*Assistant Examiner* — Kristyn Hall
(74) *Attorney, Agent, or Firm* — Michael Dae

(57) ABSTRACT

A sampling assembly has an inner expandable packer, and an outer layer formed by rings may be disposed about and/or may be positioned on the outer surface of the inner expandable packer member. Drains may be positioned between the rings and may be located under ports positioned between the rings. Flowlines may be connected to the drains, may be positioned in the rings and may extend through the rings. For each of the ports, a plate may be positioned between the port and the laterally adjacent port. The flowlines may be connected to a downstream component, such as a fluid analysis module, a fluid containment module and/or the like.

17 Claims, 6 Drawing Sheets

SYSTEM AND METHOD FOR SAMPLING ASSEMBLY WITH OUTER LAYER OF RINGS

CROSS-REFERENCE TO RELATED APPLICATIONS

This application claims benefit of U.S. provisional patent application Ser. No. 61/663,901, filed Jun. 25, 2012, which is herein incorporated by reference.

BACKGROUND

The present disclosure generally relates to a sampling assembly having an inner expandable packer. An outer layer formed by rings may be disposed about and/or may be positioned on the outer surface of the inner expandable packer member.

Hydrocarbons, such as oil and natural gas, are obtained from a subterranean geologic formation by drilling a wellbore that penetrates the hydrocarbon-bearing formation. A sealing system, such as a packer, may be deployed in a wellbore. A packer is a device having an initial outside diameter which is smaller than a wellbore in which the packer is implemented. The packer is positioned at a desired location within the wellbore. Then, a sealing element of the packer is expanded to create an increased outside diameter which forms an annular seal between the packer and a surrounding outer surface, such as a casing string or a wall of the wellbore.

The annular seal isolates the wellbore sections above the packer from the wellbore sections below the packer and may provide a mechanical anchor which prevents the packer from sliding inside the wellbore. Alternatively or additionally, the packer may have slips which are components which engage the surrounding outer surface to anchor the packer in position. Mechanically anchoring the packer is known as "setting" the packer.

A packer may be set in a cased wellbore or an uncased wellbore. After a particular operation is complete, the sealing element and/or the slips may be retracted to enable the packer to be removed or moved to another location in the wellbore.

It remains desirable to provide improvements in packers and methods of setting packers.

DETAILED DESCRIPTION

The present disclosure generally relates to a sampling assembly having an inner expandable packer. An outer layer formed by rings may be disposed about and/or may be positioned on the outer surface of the inner expandable packer member. Drains may be positioned between the rings and may be located under ports positioned between the rings. Flowlines may be connected to the drains, may be positioned in the rings and may extend through the rings. For each of the ports, a plate may be positioned between the port and a laterally adjacent port. The flowlines may be connected to a downstream component, such as a fluid analysis module, a fluid containment module and/or the like.

Figure 1:
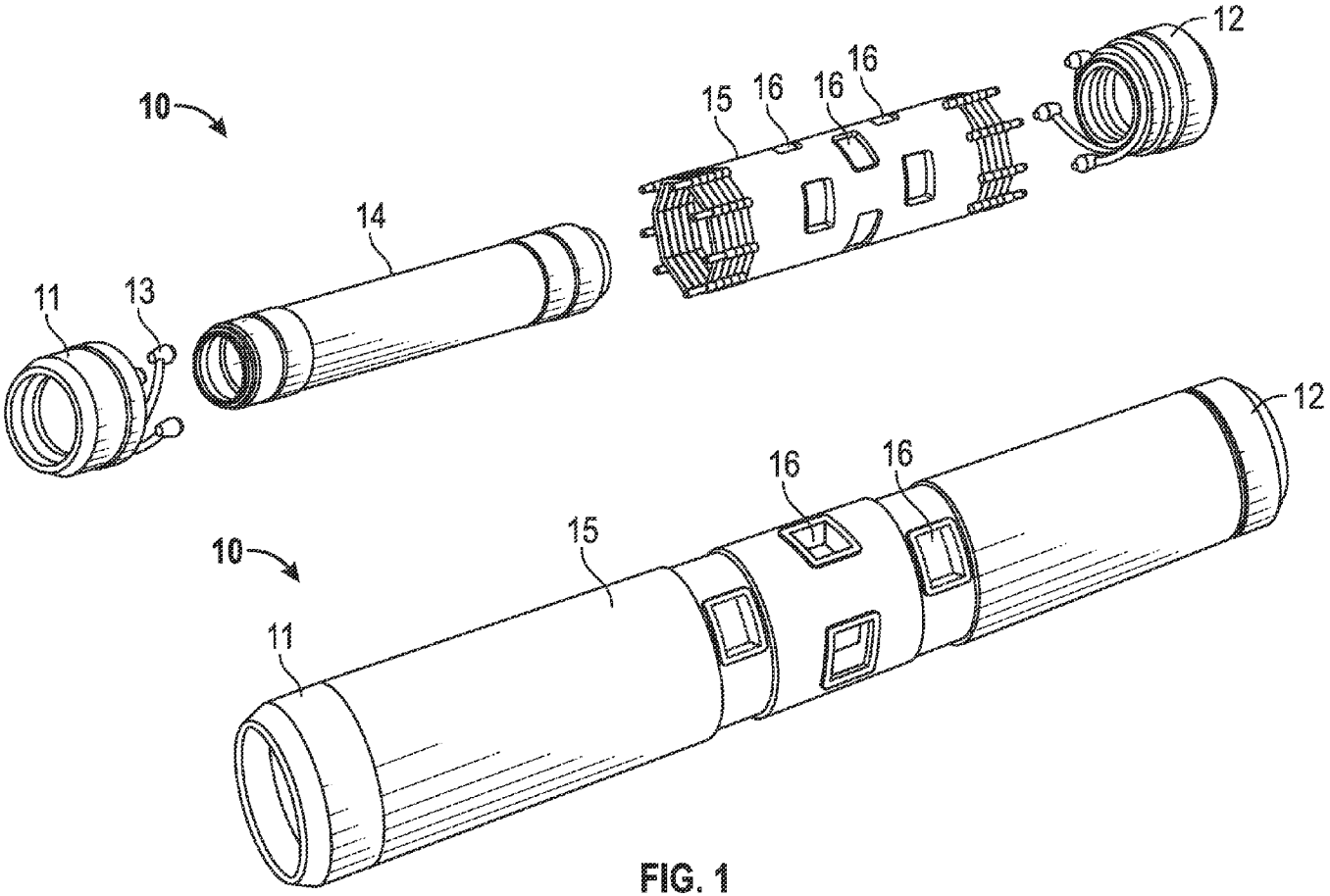
FIGS. 1, 2, 6 and 7 illustrate examples of embodiments of a sampling assembly in accordance with one or more aspects of the present disclosure.
Figure 2:
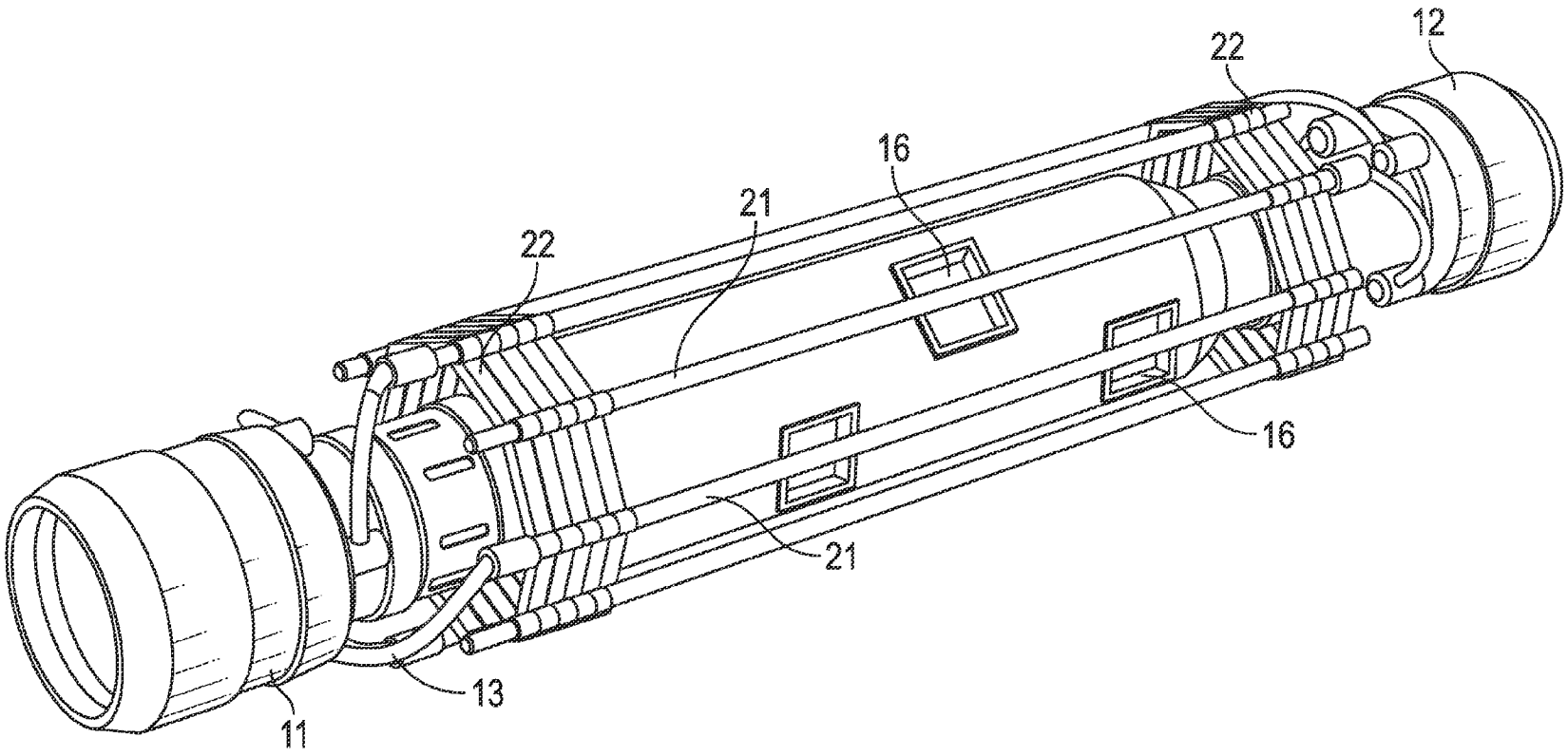

FIGS. 1 and 2 generally illustrate embodiments of a sampling assembly 10. Bottom-to-top and top-to-bottom are axial directions for the sampling assembly 10, inward-to-outward and outward-to-inward are radial directions for the sampling assembly 10, and clockwise and counter-clockwise around the circumference of the sampling assembly 10 are lateral directions.

The sampling assembly 10 may have collectors 11, 12; movable tubes 13; an inner packer member 14; an outer layer 15 which may be disposed about the inner packer member 14; and/or drains 16 in the outer layer 15. The outer layer 15 may be non-integral with the inner packer member 14. When the sampling assembly 10 is disposed within a wellbore, the inner packer member 14 may move from a retracted position to an expanded position to move the outer layer 15 into contact with a wellbore wall surrounding the sampling assembly 10.

The sampling assembly 10 may be moved from the retracted position to the expanded position by pumping a fluid into the inner packer member 14; by applying mechanical force to the inner packer member 14, such as compression or tension; by applying hydraulic pressure to the inner packer member 14; and/or the like. For example, an embodiment of the inner packer member 14 may be and/or may have an inflatable bladder that radially expands upon receipt of a predetermined amount of fluid. Any means known to one having ordinary skill in the art may be used to move the packer assembly 10 from the retracted position to the expanded position, and the packer assembly 10 is not limited to a specific means for moving the packer assembly 10 from the retracted position to the expanded position.

As shown in FIG. 2, the sampling assembly 10 may have flowlines 21 which may be disposed about and/or positioned on the inner packer member 14. The flowlines 21 may be made of metal and/or plastic. However, the flowlines 21 may be made of any material, and the flowlines 21 are not limited to a specific material.

In an embodiment, each of the collectors 11, 12 may have an inner sleeve fixedly connected to an outer sleeve. The collectors 11, 12 may deliver fluid collected from the surrounding formation to a flow system which transfers the fluid to a collection location. For example, one or more of the movable tubes 13 may transfer fluid from the flowlines 21 into the collectors 11, 12. One or more of the movable tubes 13 may be connected to the flowlines 21 in fluid communication with the drains 16 which are sampling drains, and one or more of the movable tubes 13 may be connected to the flowlines 21 in fluid communication with the drains 16 which are guard drains.

The drains 16 which are sampling drains may collect virgin fluid, and the flowlines 21 in fluid communication with the sampling drains may convey the virgin fluid. The drains 16 which are guard drains may collect contaminated fluid, and the flowlines 21 in fluid communication with the guard drains may convey the contaminated fluid. For example, the drains 16 which are sampling drains may obtain samples of clean formation fluid from a connate fluid zone, and the drains 16 which are guard drains may draw contaminated fluid from an invaded zone into the sampling assembly 10 and away from the sampling drains.

Formation fluids may be collected through the drains 16 and may be conveyed to a desired collection location. In some embodiments, the sampling assembly 10 may use a single expandable sealing element, such as the outer layer 15, which may expand across an expansion zone of the wellbore. The formation fluids may be collected from the middle of the expansion zone, namely the region between the axial ends of the sampling assembly 10.

The movable tubes 13 may be movably coupled to the flowlines 21 and one of the collectors 11, 12. For example, each of the movable tubes 13 may be capable of radial movement. Each of the movable tubes 13 may have any shape; in an embodiment, one or more of the movable tubes 13 may be generally S-shaped. The movable tubes 13 may move between a contracted configuration and an expanded configuration when the sampling assembly 10 expands.

The sampling assembly 10 may have springs 22 which may extend from one of the flowlines 21 to an adjacent one of the flowlines 21 so that at least one of the springs 22 may be connected to each of the flowlines 21. For each of the springs 22, one end may be connected to one of the flowlines 21, and the opposite end may be connected to an adjacent one of the flowlines 21.

Figure 3:
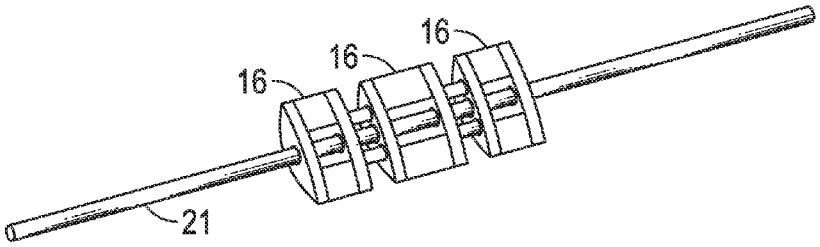
FIG. 3 illustrates an example of drains which may be implemented in an embodiment of a sampling assembly in accordance with one or more aspects of the present disclosure.

FIG. 3 generally illustrates that three of the drains 16 may be in fluid communication with one of the flowlines 21. The drains 16 may collect formation fluid when the outer layer 15 seals the sampling assembly 10 against a surrounding wellbore wall. The drains 16 may be axially aligned on the flowline 21 with which they are in fluid communication. The present disclosure is not limited to a specific number of the drains 16 in fluid communication with each of the flowlines 21, and each of the flowlines 21 may have any number of the drains 16.

Figure 4:
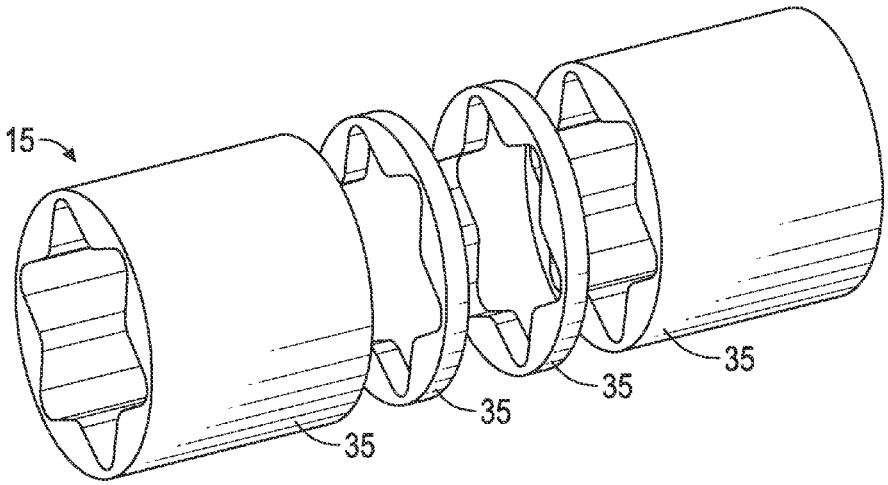
FIG. 4 illustrates an example of rings which may be implemented in an embodiment of a sampling assembly in accordance with one or more aspects of the present disclosure.

FIG. 4 generally illustrates rings 35 which may have and/or may be made of an elastomeric material, such as, for example, rubber. The rings 35 may form the outer layer 15 of the sampling assembly 10. The rings 35 may be non-integral with the inner packer member 14. In an embodiment, each of the rings 35 may have substantially the same radius. In an embodiment, the rings 35 may different axial lengths. For example, as shown in FIG. 4, the rings 35 may include two inner rings 35 which may have substantially the same axial length and may include two outer rings 35 which may have substantially the same axial length. The axial length of the two outer rings 35 may be greater than the axial length of the two inner rings 35. However, the sampling assembly 10 is not limited to a specific radius or axial length of the rings 35, and each of the rings 35 may have any radius and any axial length.

Figure 5:
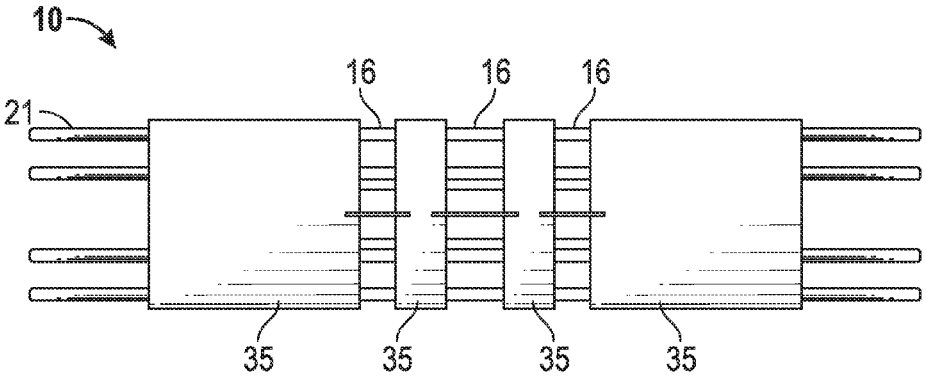
FIG. 5 illustrates an example of drains connected to rings as may be implemented in an embodiment of a sampling assembly in accordance with one or more aspects of the present disclosure.
Figure 6:
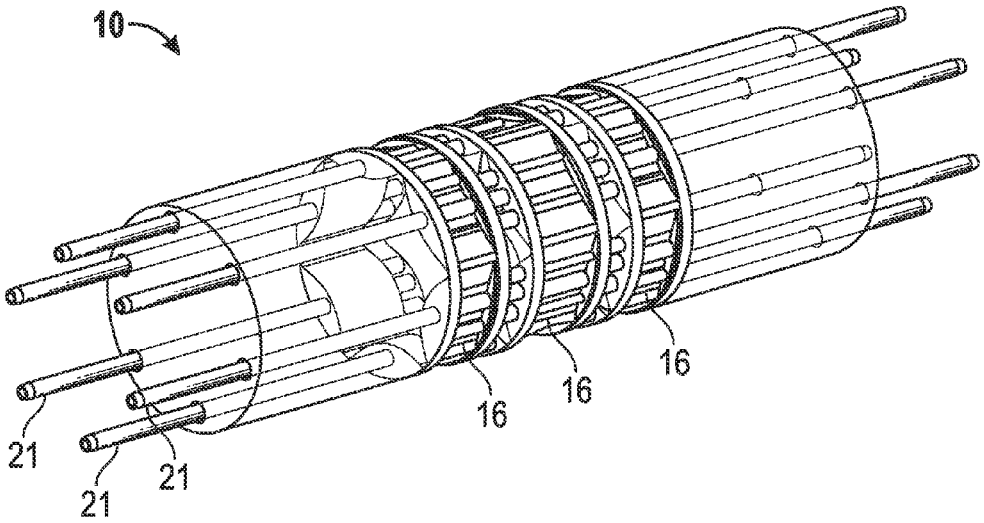

FIGS. 5 and 6 generally illustrate that the flowlines 21 may be positioned in the rings 35, and the drains 16 may be positioned between the rings 35. In an embodiment, the flowlines 21 may be embedded in the rings 35. The drains 16 may be positioned so that each of the drains 16 is located between two laterally aligned drains 16. Each of the laterally aligned drains 16 may not have elastomeric material between them and/or may laterally contact each other. In some embodiments, the rings 35 may not have elastomeric material located between them.

Each of the drains 16 may be located between the rings 35. For example, for each of the drains 16, one of the rings 35 may be located on one axial side of the drain 16, and another one of the rings 35 may be located on the opposite axial side of the drain 16. FIGS. 4-6 depict four of the rings 35, but the flowlines 21 and the drains 30 may be used with any number of the rings 35, and the sampling assembly 10 may have any number of the rings 35.

Figure 7:
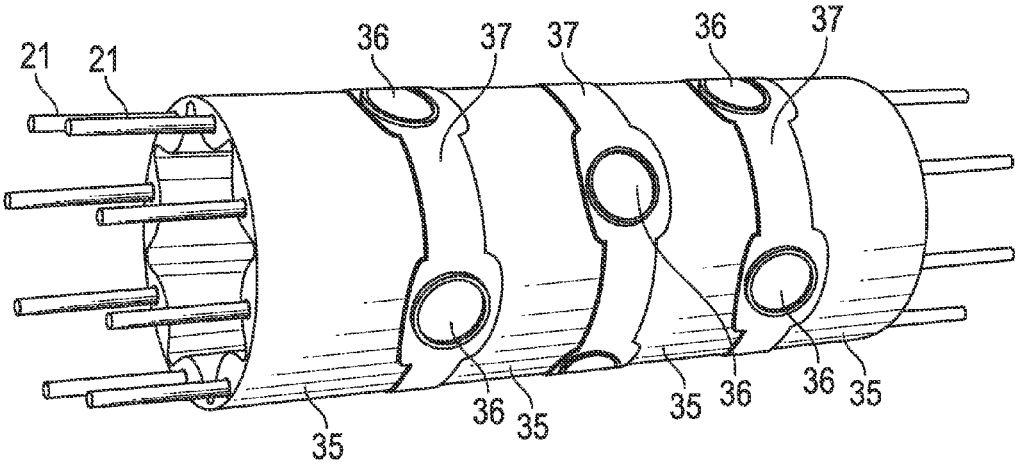

As shown in FIG. 7, ports 36 may be positioned over the drains 16 in the sampling assembly 10. Each of the ports 36 may be located between the rings 35. For example, for each of the ports 36, one of the rings 35 may be located on one axial side of the port 36, and another one of the rings 35 may be located on the opposite axial side of the port 36.

As shown in FIG. 7, each of the ports 36 may have at least one other port 36 which is located at the same axial distance and/or laterally aligned. Each of the ports 36 which are located at the same axial distance and/or laterally aligned may not have elastomeric material between them. For each of the ports 36, a plate 37 may be located between the port 36 and the other port 36 which is located at the same axial distance and/or laterally aligned. The plate 37 may be a plate of metal and/or plastic; for example, in some embodiments, the plate 37 may be a plate of porous material, such as sintered metal, and/or may be a metallic mesh screen. In some embodiments, the plate 37 may have grooves formed thereon. However, the sampling assembly 10 is not limited to a specific embodiment of the plate 37.

Figure 8:
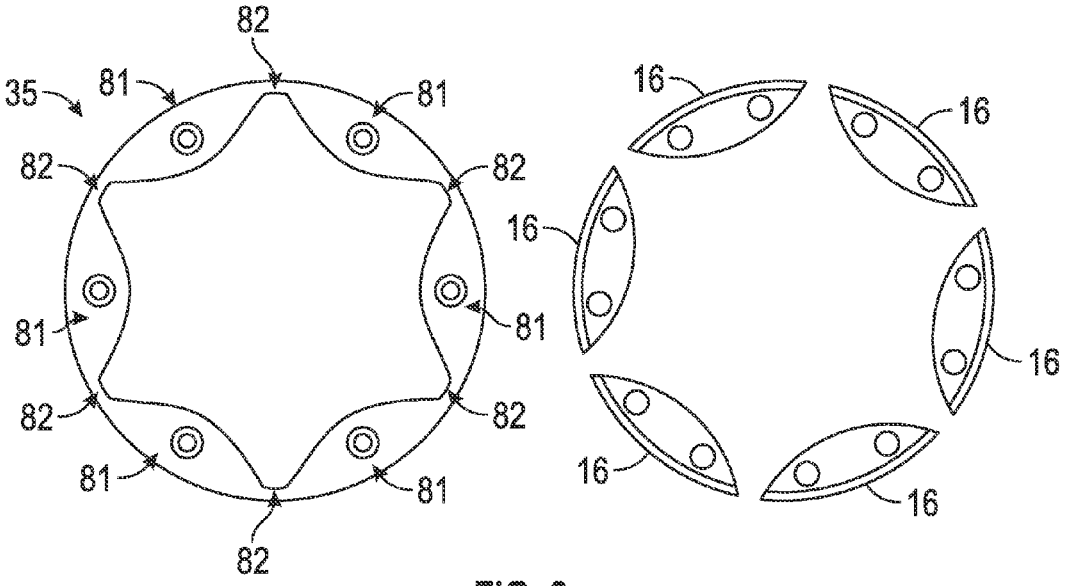
FIG. 8 illustrates a cross-sectional view of an example of an embodiment of a sampling assembly in accordance with one or more aspects of the present disclosure.

As generally illustrated in FIG. 8, each of the rings 35 may be formed by a plurality of sealing bodies 81 and/or a plurality of connector portions 82. In some embodiments, the plurality of sealing bodies 81 may be integral with the plurality of connector portions 82. The plurality of sealing bodies 81 and/or the plurality of connector portions 82 may be made of an elastomeric material, such as, for example, rubber.

Each of the sealing bodies 81 may have any shape; in an embodiment, each of the sealing bodies 81 may have an oval cross-section so that each of the sealing bodies 81 may have a lateral axis of symmetry and a radial axis of symmetry. In some embodiments, the cross-section of each of the plurality of sealing bodies 81 may be the substantially same shape as the cross-section of each of the drains 16. For each of the rings 35, each of the plurality of sealing bodies 81 may be axially aligned with one or more of the drains 16. In an embodiment where four of the rings 35 are implemented, four of the plurality of sealing bodies 81 may be aligned with one or more of the drains 16. For example, for each of the rings 35, one of the plurality of sealing bodies 81 may be axially aligned with one or more of the drains 16 and one of the plurality of sealing bodies 81 of each of the other rings 35.

Each of the plurality of connector portions 82 may have a radial width which is less than the radial width of each of the plurality of sealing bodies 81. For example, each of the plurality of sealing bodies 81 may have an outer apex which is the portion of the sealing body 81 farthest from the inner packer member 14; each of the plurality of sealing bodies 81 may have an inner apex which is the portion of the sealing body 81 closest from the inner packer member 14; and each of the plurality of connector portions 82 may have a radial width which is one-tenth of the distance between the outer apex and the inner apex.

Figure 9:
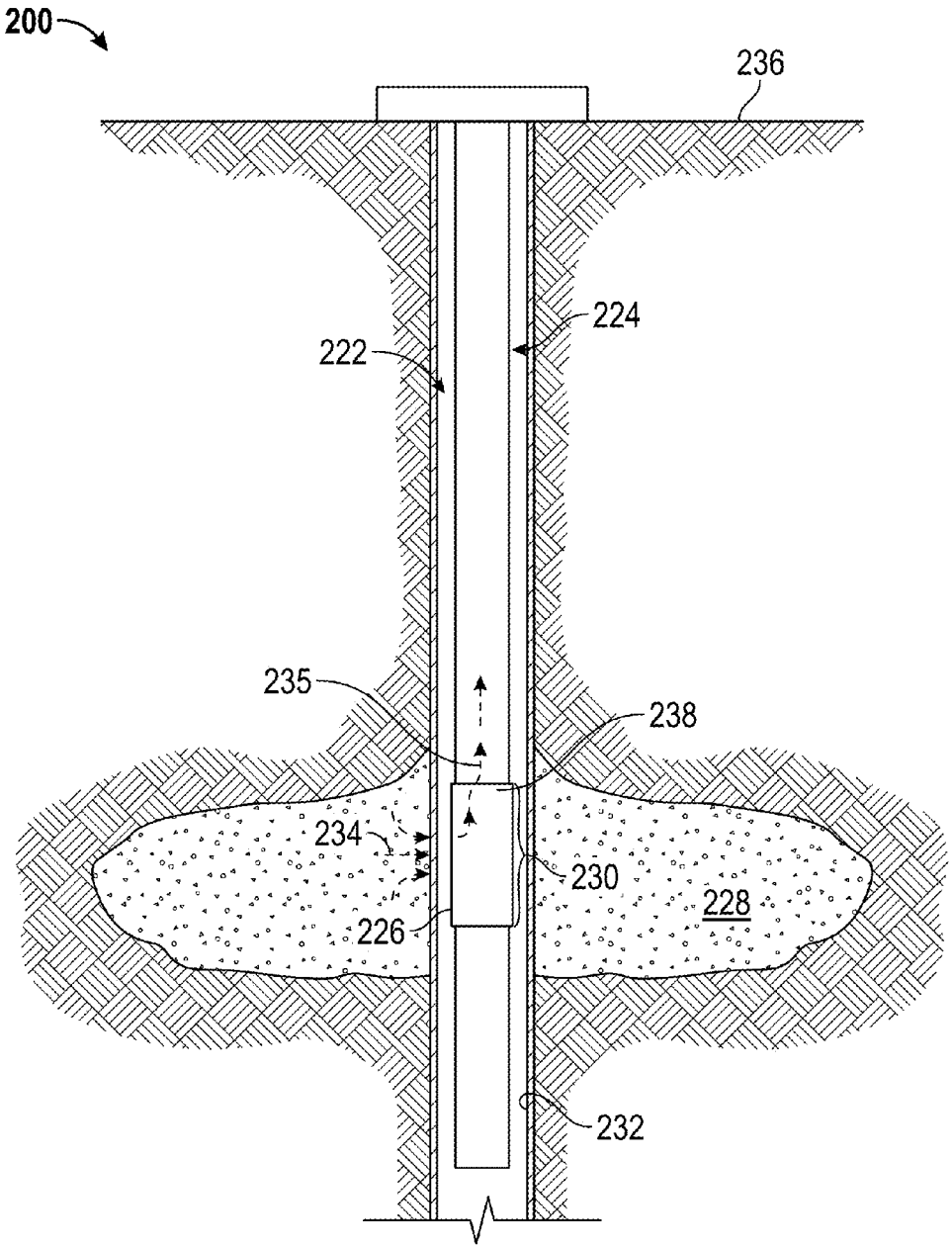
FIG. 9 illustrates an example of a wellbore system in which embodiments of a sampling assembly may be employed in accordance with one or more aspects of the present disclosure.

FIG. 9 generally illustrates an embodiment of a well system 200. The well system 200 may have a conveyance 224 employed for delivery into a wellbore 222 of at least one packer assembly 226, such as the packer assembly 100, the packer assembly 40, the packer assembly 50, the packer assembly 60, the packer assembly 80 and/or another type of packer assembly. The conveyance 224 may be a wireline, a tubing string, and/or the like. The packer 226 may collect formation fluids from a surrounding formation 228.

The packer 226 may be positioned in the wellbore 222 and then may be expanded in a radially outward direction to seal across an expansion zone 230 with a surrounding wellbore wall 232, such as a surrounding casing or open wellbore wall. When the packer 226 is expanded to seal against the surrounding wellbore wall 232, formation fluids may be obtained by the packer 226 as indicated by arrows 234. The formation fluids obtained by the packer 226 may be directed to a flow line 235 and may be carried to a collection location, such as a location at a well site surface 236. A viscosity lowering system 238 may be incorporated into the packer 226 to enable selective lowering of the viscosity of a substance, such as oil, to be sampled through the packer 226.

The preceding description has been presented with reference to present embodiments. Persons skilled in the art and technology to which this disclosure pertains will appreciate that alterations and changes in the described structures and methods of operation can be practiced without meaningfully departing from the principle and scope of the disclosure. Accordingly, the foregoing description should not be read as pertaining only to the precise structures described and shown in the accompanying drawings, but rather should be read as consistent with and as support for the following claims, which are to have their fullest and fairest scope.

Moreover, means-plus-function clauses in the claims cover the structures described herein as performing the recited function and not only structural equivalents but also equivalent structures. Thus, a nail and a screw may not be structural equivalents because a nail employs a cylindrical surface to secure parts together and a screw employs a helical surface, but in the environment of fastening parts, a nail may be the equivalent structure to a screw. Applicant expressly intends to not invoke 35 U.S.C. §112, paragraph 6, for any of the limitations of the claims herein except for claims which explicitly use the words "means for" with a function.

The invention claimed is:

1. A sampling assembly comprising:

an expandable inner packer member having an outer surface;

a first ring disposed on the outer surface of the expandable inner packer member, the first ring having a first sealing body;

a second ring disposed on the outer surface of the expandable inner packer member, the second ring having a second sealing body;

a drain positioned between the first ring and the second ring, the drain being axially aligned with the first sealing body and the second sealing body;

an additional drain located between the first ring and the second ring and laterally aligned with the drain, wherein the first ring comprises a third sealing body, the second ring comprises a fourth sealing body, and the third sealing body and the fourth sealing body are axially aligned with the additional drain; and a connector integral with the third sealing body and the first sealing body to connect the third sealing body to the first sealing body, the connector having a radial width less than the radial width of the third sealing body and the first sealing body.

2. The sampling assembly of claim 1 wherein the expandable inner packer member comprises an inflatable bladder that radially expands upon receipt of a predetermined amount of fluid.

3. The sampling assembly of claim 1 wherein at least one of the first ring and the second ring are non-integral with the expandable inner packer member.

4. The sampling assembly of claim 1 wherein the first sealing body, the second sealing body and the drain have the same cross-sectional shape.

5. The sampling assembly of claim 1 wherein at least one of the first ring and the second ring is made of an elastomeric material sealable against a wall of a wellbore or casing within a wellbore.

6. The sampling assembly of claim 1 further comprising a flowline within the first sealing body and the second sealing body and in fluid communication with the drain such that at least a portion of formation fluid received by the drain flows into the flowline.

7. The sampling assembly of claim 1 wherein the drain and the additional drain do not have elastomeric material therebetween.

8. The sampling assembly of claim 1 wherein the drain and the additional drain laterally contact each other.

9. The sampling assembly of claim 1 further comprising:

a port located between the first sealing body and the second sealing body, the drain being located under the port.

10. The sampling assembly of claim 9 further comprising:

an additional port located between the first sealing body and the second sealing body, the additional drain being located under the additional port; and a plate located between the port and the additional port, the plate being located between the first ring and the second ring.

11. A method comprising:

deploying a sampling assembly into a wellbore, the sampling assembly having an expandable packer member positioned within rings and having drains located between the rings to provide fluid communication between the wellbore and the sampling assembly, wherein each of the rings comprises a plurality of sealing bodies, and the sampling assembly has connectors integral with the plurality of sealing bodies, each of the connectors having a radial width less than the radial width of each of the plurality of sealing bodies and connecting one of the plurality of sealing bodies to a laterally adjacent one of the plurality of sealing bodies;

expanding the expandable packer member to move the rings against a wall of a wellbore to create an annular seal to substantially prevent fluid communication between an area above the sampling assembly and an area below the sampling assembly; and drawing formation fluid into the sampling assembly through at least one of the drains.

12. The method of claim 11 wherein each of the plurality of sealing bodies is axially aligned with one of the drains and axially aligned with one of the plurality of sealing bodies of each of the other rings.

13. The method of claim 12 wherein each of the plurality of sealing bodies is axially aligned with one of the drains and axially aligned with one of the plurality of sealing bodies of each of the other rings before expanding the expandable packer member.

14. The method of claim 12 wherein each of the plurality of sealing bodies is axially aligned with one of the drains and one of the plurality of sealing bodies of the other rings after expanding the expandable packer member.

15. A sampling assembly comprising:

an expandable inner packer member having an outer surface;

sealing bodies disposed on the outer surface of the expandable inner packer member, at least one of the sealing bodies having a flowline positioned therein; and connectors integral with the sealing bodies, each of the connectors having a radial width less than the radial width of the sealing bodies and connecting one of the sealing bodies to a laterally adjacent one of the sealing bodies.

16. The sampling assembly of claim 15 wherein the sealing bodies form a first ring and a second ring, the first ring being non-integral with the second ring and located at a different axial distance than the second ring.

17. The sampling assembly of claim 15 further comprising:

a drain in fluid communication with the flowline, the drain being located between one of the sealing bodies and another one of the sealing bodies, wherein the sealing bodies which the drain is located between and the drain are axially aligned.

* * * * *